US006492627B1

(12) United States Patent
Ensinger et al.

(10) Patent No.: US 6,492,627 B1
(45) Date of Patent: Dec. 10, 2002

(54) HEATING UNIT AND CONTROL SYSTEM FOR COOKTOPS HAVING CAPABILITY TO DETECT PRESENCE OF A PAN AND METHODS OF OPERATING SAME

(75) Inventors: James W. Ensinger, Buffalo Grove, IL (US); Gregory A. Peterson, South Barrington, IL (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/915,897

(22) Filed: Jul. 26, 2001

(51) Int. Cl.[7] ..... H05B 1/02; H05B 3/68
(52) U.S. Cl. ..... 219/518; 219/447.1; 219/460.1
(58) Field of Search ..... 219/446.1, 447.1, 219/448.11, 448.12, 448.13, 460.1, 490, 497, 507, 509, 518, 620, 621, 626

(56) References Cited

U.S. PATENT DOCUMENTS

| | | | | | |
|---|---|---|---|---|---|
| 3,068,340 | A | | 12/1962 | Bremer et al. | 219/37 |
| 3,646,321 | A | | 2/1972 | Siegla | 219/464 |
| 3,742,179 | A | | 6/1973 | Harnden, Jr. | 219/10.77 |
| 3,796,850 | A | | 3/1974 | Moreland, II et al. | 219/10.49 |
| 3,833,793 | A | | 9/1974 | McWilliams et al. | 219/464 |
| 4,010,412 | A | | 3/1977 | Forman | 323/18 |
| 4,032,750 | A | | 6/1977 | Hurko | 219/464 |
| 4,214,151 | A | | 7/1980 | Kicherer et al. | 219/492 |
| 4,237,368 | A | | 12/1980 | Welch | 219/449 |
| 4,499,368 | A | | 2/1985 | Payne | 219/452 |
| 4,816,647 | A | | 3/1989 | Payne | 219/464 |
| 5,128,516 | A | | 7/1992 | Plasko et al. | 219/497 |
| 5,136,277 | A | * | 8/1992 | Civanelli et al. | 219/445.1 |
| 5,243,172 | A | | 9/1993 | Hazan et al. | 219/450 |
| 5,256,860 | A | | 10/1993 | Newman et al. | 219/464 |
| 5,293,028 | A | | 3/1994 | Payne | 219/486 |
| RE34,671 | E | | 7/1994 | Long | 99/386 |
| 5,349,163 | A | | 9/1994 | An | 219/492 |
| 5,397,873 | A | | 3/1995 | Stoops et al. | 219/450 |
| 5,430,427 | A | | 7/1995 | Newman et al. | 338/22 R |
| 5,504,295 | A | | 4/1996 | Collas et al. | 219/443 |
| 5,658,478 | A | * | 8/1997 | Roeschel et al. | 219/502 |
| 5,658,480 | A | | 8/1997 | Tennant et al. | 219/519 |
| 5,721,419 | A | | 2/1998 | Wauer et al. | 219/497 |
| 5,780,817 | A | | 7/1998 | Eckman et al. | 219/458 |
| 5,856,654 | A | | 1/1999 | Frasnetti et al. | 219/481 |
| 5,877,475 | A | | 3/1999 | Hecht et al. | 219/449 |
| 5,893,996 | A | | 4/1999 | Gross et al. | 219/452 |
| 5,900,174 | A | * | 5/1999 | Scott | 219/447.1 |
| 5,953,982 | A | | 9/1999 | Curry | 99/344 |
| 5,981,916 | A | | 11/1999 | Griffiths et al. | 219/492 |
| 6,140,617 | A | | 10/2000 | Berkcan et al. | 219/446.1 |
| 6,259,069 | B1 | * | 7/2001 | Schotten et al. | 219/447.1 |

* cited by examiner

*Primary Examiner*—Sang Paik
(74) *Attorney, Agent, or Firm*—Howrey Simon Arnold & White LLP

(57) ABSTRACT

The present invention provides a control system for a heating unit in a cooktop that is capable of detecting the presence (or absence) of a cooking pan or utensil. The heating unit has a spirally wound ribbon heater element and may be mounted below a glass-ceramic cooking surface. The control system includes a pan detection unit electrically connected to the heater element. The pan detection unit generates a high frequency signal through the heater element to determine whether a pan is present on the cooktop. The pan detection unit may have an oscillation circuit to generate the high frequency signal through the heater element. In one embodiment, the control system further includes at least one switch device that is connected between the heater element and a power source. The switch device is opened to remove the heater element from the power source when the pan detection unit generates the high frequency signal through the heater element. The present invention also includes a heating unit having dual heater units to determine the size of the pan placed on the cooktop. The present invention further includes methods of operating a heater unit and control system having the capability of detecting the presence of a pan.

34 Claims, 9 Drawing Sheets

HEATING UNIT AND CONTROL SYSTEM FOR COOKTOPS HAVING CAPABILITY TO DETECT PRESENCE OF A PAN AND METHODS OF OPERATING SAME

FIELD OF THE INVENTION

The present invention relates generally to cooktop ranges, and more particularly, to radiant electric heating units and control systems for cooktop ranges having the capability of detecting the presence of a cooking pan or utensil and methods of operating the same.

BACKGROUND OF THE INVENTION

Several conventional cooktop ranges have a smooth glass-ceramic cooking surface. Mounted below the glass-ceramic cooking surface is one or more radiant electric heating units comprising typically of a coiled heater element. Power is supplied to the coiled heater element to heat a cooking pan or utensil placed on the glass-ceramic cooking surface. The glass-ceramic cooking surface is easier to clean than other types of cooktop ranges such as a gas range or a range that requires the pan to be placed directly on top of the heater element.

It has been known to detect the presence of a cooking pan or utensil on a cooktop range by using devices such as a weight sensor, a reed switch, or an optical sensor. These systems require extra components that may be subject to failure due to the high temperature environment of the heating unit.

Other previous attempts at pan detection involve placing coils around the outside of the heating element, embedding wires in the glass-ceramic cooking surface, or bonding wires to the bottom surface of the glass-ceramic cooking surface. More recently, there have been systems that deposit a gold foil pattern on the bottom surface of the glass-ceramic cooking surface. A current is sent through the wire or foil and any changes in the inductance is used by the control system of the cooktop to determine if a pan is present or absent. Each of these techniques requires expensive processing steps and requires materials that are capable of withstanding the high temperature environment. Moreover, replacement and maintenance of these systems may be difficult if the wire or foil fails.

The present invention is directed to overcoming, or at least reducing the effects of, one or more of the problems set forth above.

SUMMARY OF THE INVENTION

To that end, the present invention includes a control system for a heating unit in a cooktop that is capable of detecting the presence (or absence) of a cooking pan or utensil. The heating unit has a spirally wound ribbon heater element and may be mounted below a glass-ceramic cooking surface. The control system includes a pan detection unit electrically connected to the heater element. The pan detection unit generates a high frequency signal through the heater element to determine whether a pan is present on the cooktop. The pan detection unit may have an oscillation circuit to generate the high frequency signal through the heater element.

The control system may further include an electronic control unit that is electrically connected to the pan detection unit. The electronic control unit is capable of generating a signal to the pan detection unit to enable the pan detection unit to generate the high frequency signal through the heater element. In response, the pan detection unit is capable of sending a response signal to the electronic control unit that may reflect at least a portion of the reactance of the heater element. The electronic control unit may use this information to determine whether a pan is present. The control system may also include a user interface that is electrically connected to the electronic control unit.

The control system may further include at least one switch device. The at least one switch device is connected between the heater element and a power source. In one embodiment, the at least one switch device is opened when the pan detection unit generates the high frequency signal through the heater element.

In another embodiment, the present invention includes a control system for a heating unit in a cooktop that includes a pan detection unit, and at least one switch device. The heating unit has a heater element with a first terminal end and a second terminal end. The pan detection unit is electrically connected to the first and second terminal ends of the heater element. The pan detection unit is capable of generating a high frequency signal through the heater element to determine whether a pan is present on the cooktop. The at least one switch device is electrically connected between the heater element and a power source. The at least one switch device is opened to remove the power source from the heater element when the pan detection unit generates the high frequency signal through the heater element.

In a further embodiment, the present invention includes a control system for a heating unit with dual heater elements in a cooktop. In particular, the heating unit has an inner heater element and an outer heater element. The inner heater is spirally wound within the outer heater element. The control system includes a pan detection unit, a first switch device, and a second switch device. The pan detection unit is electrically connected to the inner and outer heater elements. The pan detection unit is capable of generating a high frequency signal through the inner heater element to determine whether a pan is present on the cooktop. The pan detection unit is also capable of generating a high frequency signal through the outer heater element to determine the size of the pan on the cooktop. The first switch device is electrically connected between the inner heater element and a power source. The first switch device is opened to remove the power source from the inner heater element when the pan detection unit generates the high frequency signal through the inner heater element in determining whether a pan is present on the cooktop. The second switch device is electrically connected between the outer heater element and the power source. The second switch device is opened to remove the power source from the outer heater element when the pan detection unit generates the high frequency signal through the outer heater in determining the size of the pan on the cooktop.

A further embodiment of the present invention includes a method of operating a heating unit for a cooktop with a control system that is capable of detecting whether a pan is present on the cooktop. The heating unit has a heater element and may be mounted below a glass-ceramic cooking surface. The method includes the steps of: receiving a setting from a user of the cooktop; generating a high frequency signal through the heater element; determining whether the pan is present on the cooktop from the generation of the high frequency signal through the heater element; isolating power to the heater element if it is determined that the pan is not present on the cooktop; providing power to the heater element if it is determined that the pan is present on the cooktop; determining whether the pan has been removed from the cooktop after power has been provided to the heater element; isolating power to the heater element if it is determined that the pan has been removed from the cooktop; and providing power to the heater element if it is determined that the pan has not been removed from the cooktop.

The step of generating the high frequency signal through the heater element may be performed by a pan detection unit having an oscillation circuit. The step of determining whether the pan is present on the cooktop may be performed by an electronic control unit that is electrically connected to the pan detection unit. The step of determining whether the pan has been removed from the cooktop may be performed by an electronic control unit that is electrically connected to the pan detection unit.

The above summary of the present invention is not intended to represent each embodiment, or every aspect of the present invention. This is the purpose of the figures and detailed description that follows.

BRIEF DESCRIPTION OF THE DRAWINGS

Other objects and advantages of the invention will become apparent upon reading the following detailed description and upon reference to the drawings.

Figure 1:
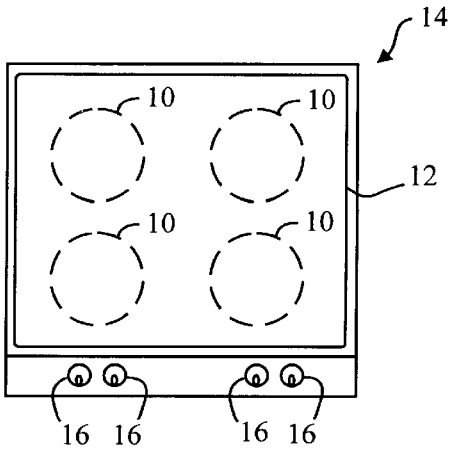
FIG. 1 is a top view of a cooktop stove having four heating units of the present invention.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Illustrative embodiments will now be described with reference to the accompanying figures. Turning to the drawings, FIG. 1 shows a plurality (four) of heating units 10 of the present invention installed below a cooking surface 12 in a cooktop 14. The heating units 10 may each have the same wattage or the heating units 10 may have different wattages. Someone desiring to cook food or heat liquids places the food or liquid in a utensil (not shown) which is then set upon the cooking surface 12 above one of the heating units 10. The user then turns the corresponding control knob 16 or other temperature control device to a setting indicating the temperature to be produced by the heating unit 10 to heat the food or liquid.

The cooking surface 12 may be a single sheet made of an infrared transmissive material such as glass-ceramic. A suitable material is designated as CERAN manufactured by Schott Glass in Mainz, Germany or EuroKera Glass Ceramic manufactured by EuroKera North America, Inc. in Fountain Inn, S.C. The use of such a glass-ceramic material maximizes the transmission of radiated heat from the heater element to a cooking pan or utensil that may rest on top of the cooking surface 12.

Figure 2A:
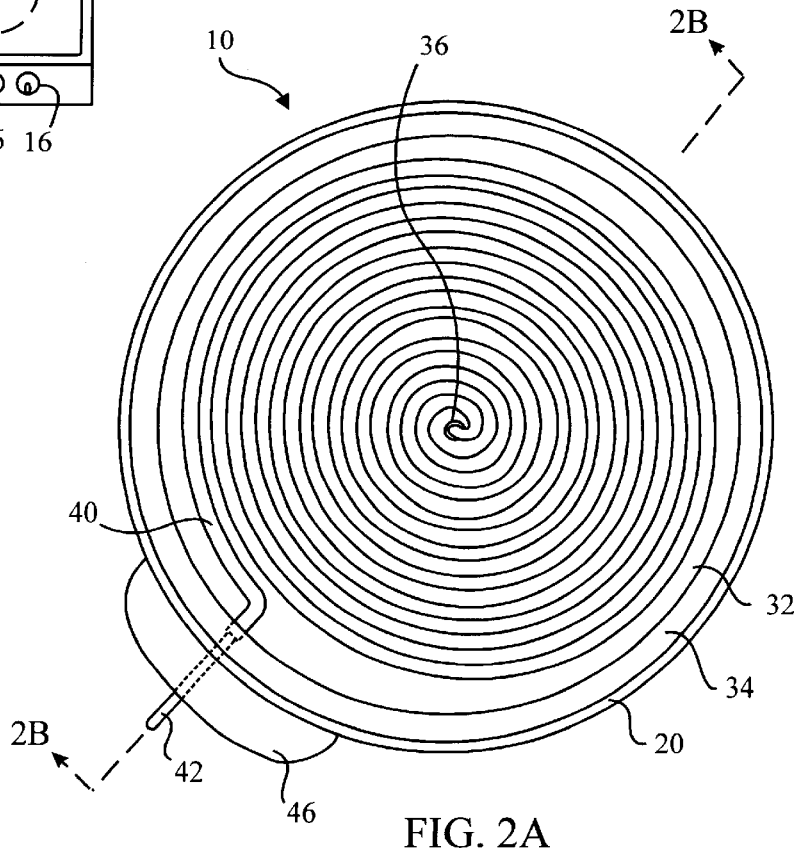
FIG. 2A is a top view of one embodiment of a heating unit of the present invention.
Figure 2B:
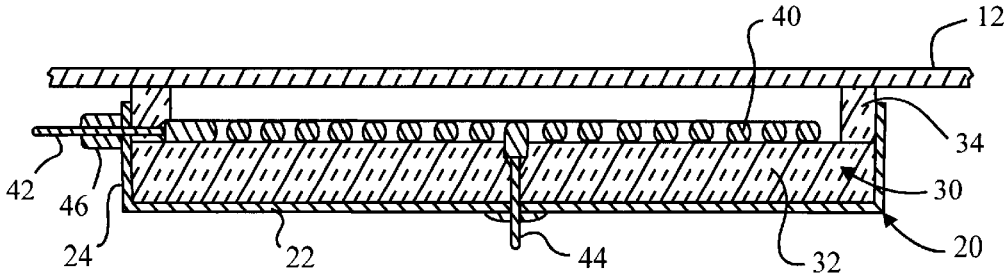
FIG. 2B is a cross-sectional view of the heating unit in FIG. 2A.

As shown in FIGS. 2A and 2B, in one embodiment, the heating unit 10 includes a support pan 20, an insulation layer 30, and a heater element 40. The support pan 20 is disposed beneath the cooking surface 12 and may be a shallow pan having a substantially flat base 22 and a circumferential sidewall 24. The insulation layer 30 is supported inside the support pan 20. Specifically, in one embodiment, as shown in FIG. 2B, the insulation layer 30 has an insulation cake base 32 and an insulation sidewall ring 34. Although FIG. 2B shows the insulation layer 30 as two separate components, the insulation cake base 32 and the sidewall ring 34 may be a single unitary body. Suitable materials for the insulation layer include Wacker WDS® Thermal Insulation from Wacker Silicones Corp. in Adrian, Mich. and RPC2100 from Thermal Ceramics in Augusta, Ga.

The heater element 40 is supported on the insulation cake base 32 of the insulation layer 30. The presence of the insulation sidewall ring 34 permits the heater element 40 to be in a spaced-apart relationship to the cooking surface 12. The insulation sidewall ring 34 further assists in confining the heat to the area directly above the heater element 40 by minimizing the amount of heat loss to the sides of the heater unit 10.

The heater element 40 is preferably an electric ribbon-type heater element. The heater element 40 radiates infrared energy. The heater element 40 has a first and second terminal end 42, 44 that allows the heater element to be electrically connected to a control system 60 (see FIG. 6) that supplies power through the heater element 40. Conventional heater elements typically have a serpentine, sinuous or zigzag pattern. However, in the present invention, it is preferred that the heater element have a spirally wound pattern when installed on the insulation cake base 32. In one embodiment, the first terminal end 42 of the heater element 40 is connected to the control system 60 via the terminal block 46. The second terminal end 44 of the heater element 40 passes through a center hole 36 in the insulation cake base 32 to connect to the control system 60.

It is now desirable to have a heating unit 10 with a control system 60 that is capable of detecting the presence (or absence) of a cooking pan or utensil. Detecting the presence of a cooking pan or utensil can provide safety and operational advantages to an electronically controlled cooktop 14. As a safety improvement, the control system 60 can automatically disable power to the heater element 40 where a cooking pan or utensil has been removed. This would decrease the likelihood of an accidental burn to users of the cooktop 14. The control system 60 can also disregard the user's request to turn on the cooktop 14 when no cooking pan or utensil is sensed on the cooking surface 12 of the cooktop 14. As an operational improvement, the heating unit 10 could perform a fast heating cycle by applying more energy to the heater element 40 when the control system 60 senses the presence of a cooking pan or utensil.

Figure 3A:
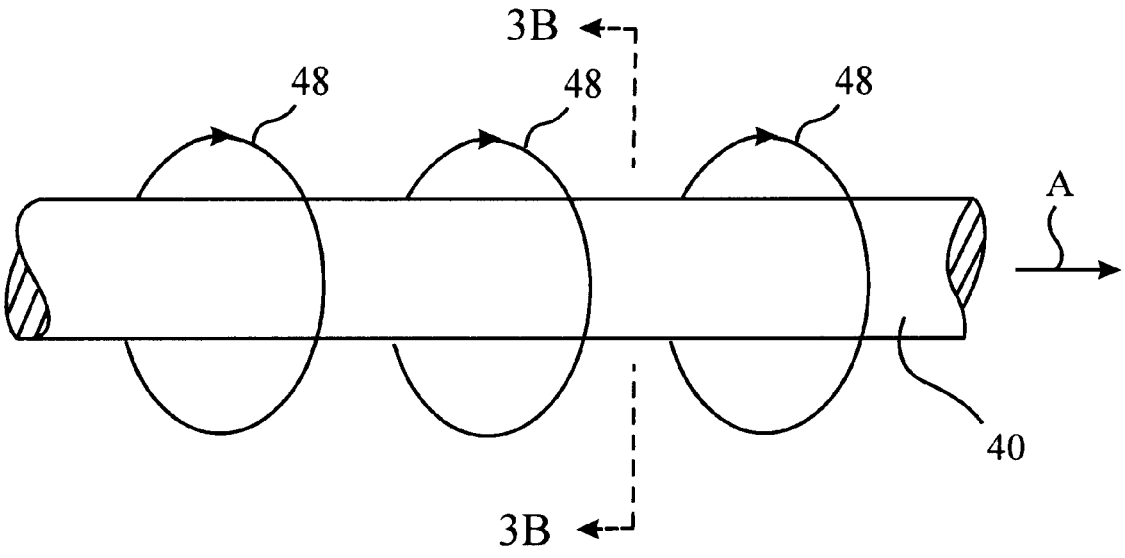
FIG. 3A is a side view of a portion of a heater element of the heating unit in FIG. 2A showing the electromagnetic field that is created when a signal is applied to the heater element.
Figure 3B:
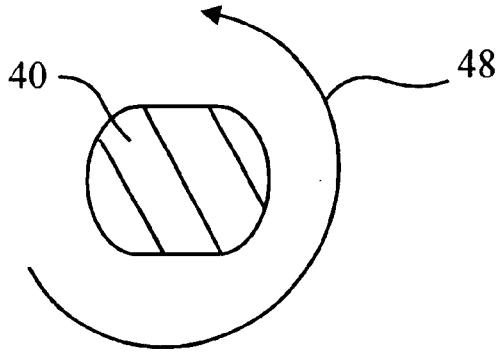
FIG. 3B is a cross-sectional view of the heater element in FIG. 3A.

To this end, the present invention includes a control system 60 that uses the electromagnetic effects of an electrically conductive cooking pan or utensil upon the electrical reactance of the spirally wound, electric ribbon-type heater element 40 to detect the presence (or absence) of the cooking pan or utensil. Referring to FIGS. 3A and 3B, the heater element 40 is excited by a radio frequency signal (in direction A) that produces an electromagnetic field 48. The presence of a cooking pan or utensil (not shown) disrupts the electromagnetic field causing an apparent change in the reactance of the heater element 40. The change of reactance can be measured at the first and second terminal ends 42, 44 of the heater element 40.

In the present invention, as mentioned above, it is preferable that the heater element 40 be in a spirally wound pattern. Many conventional heating units have heater elements that are in a serpentine, sinuous or zigzag pattern. Such conventional patterns are relatively non-inductive due to the cancellation of the electromagnetic fields from alternating clock-wise and counter-clockwise portions of the pattern. This will not generate sufficient electromagnetic fields in the region of the pan and, thus, are typically not adequate to be used to detect the presence (or absence) of a cooking pan or utensil. The spirally wound pattern shown in FIG. 2A, however, eliminates the cancellation effects of the zigzag pattern and allows the generation of measurable electromagnetic fields in the region of the cooking pan or utensil.

Moreover, several conventional heating units have heater elements that are made of helical wound wires. A helical wound wire axially concentrates the magnetic fields to the interior of the helix. The exterior fields of a helical wound wire are generally confined to the space just outside the helix without generating fields in the region of a cooking pan or utensil. Accordingly, this typically makes a helical wound-type heater element unsuitable. A heater element made of a flat electrical ribbon, however, readily generates fields in the region of a cooking pan or utensil and, therefore, is useful in detecting the absence or presence of the cooking pan or utensil.

As explained in the background section, prior systems have used expensive processing steps to deposit gold or other materials to the glass-ceramic cooking surface of the cooktop. The present invention, however, uses the heater element 40 to sense the presence of a cooking pan or utensil. Using the heater element 40 eliminates the need to add expensive sensing devices that must withstand the high temperature environment.

The embodiment in FIGS. 2A and 2B shows the first and second terminal ends 42, 44 of the heater element 40 in different locations. This may not be suitable for all applications because it does not permit immediate access to both terminal ends 42, 44 in a single terminal block at the outer edge of the heating unit 10. In some applications, the terminal ends of a heater element may need to be located in a single terminal block at the outer edge of the heating unit. Accordingly, FIGS. 4A, 4B and 5A, 5B show alternative embodiments of a heating unit according to the present invention that allows access to both terminal ends in a single terminal block at the outer edge of the heating unit.

Figure 4A:
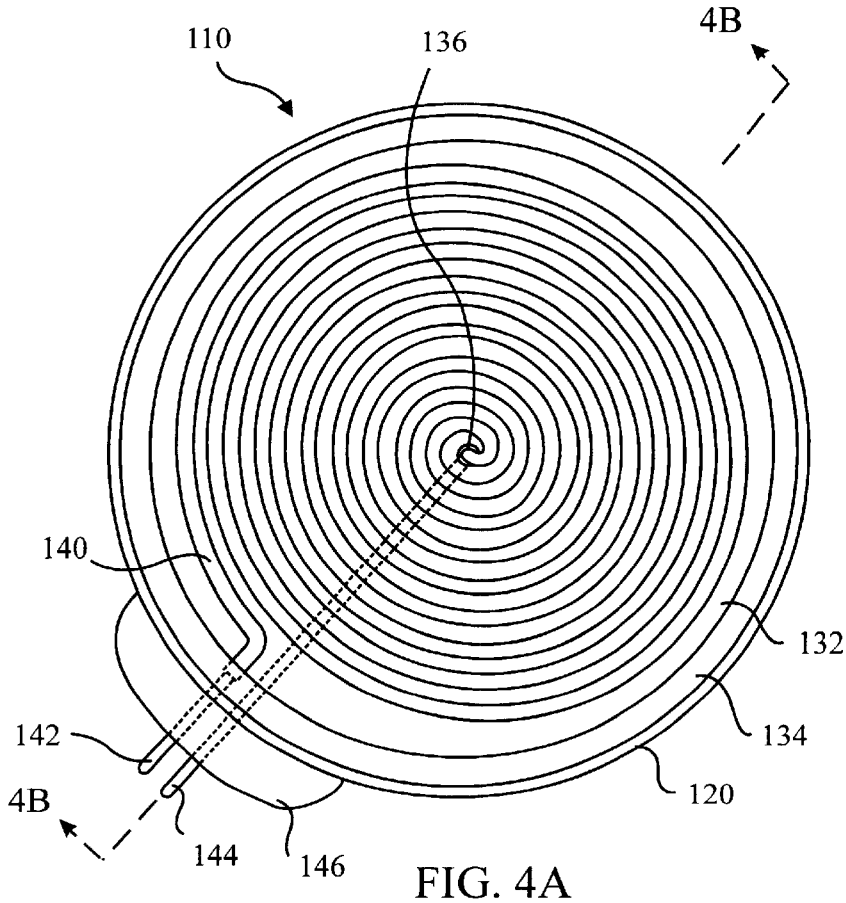
FIG. 4A is a top view of an alternative embodiment of a heating unit of the present invention.
Figure 4B:
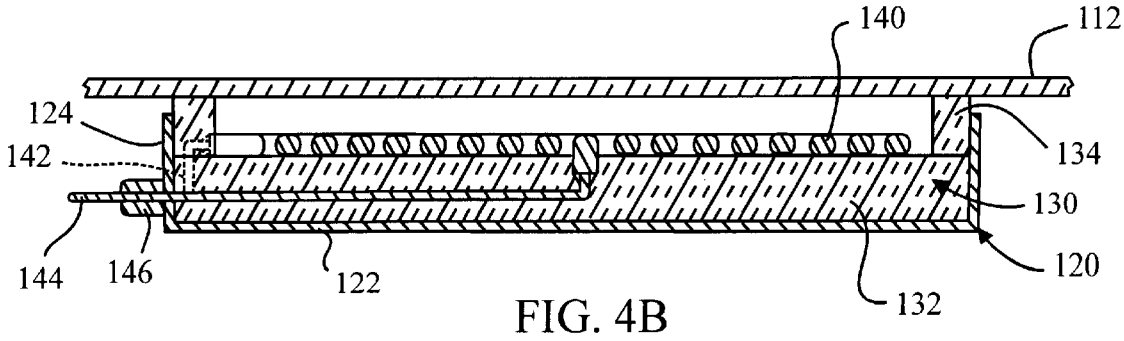
FIG. 4B is a cross-sectional view of the heating unit in FIG. 4A.

In FIGS. 4A and 4B, a heating unit 110 includes a support pan 120, an insulation layer 130, and a heater element 140. The support pan 120 is disposed beneath the cooking surface 12 and may comprise a substantially flat base 122 and a circumferential sidewall 124. The insulation layer 130 is supported inside the support pan 120. The insulation layer 130 may have an insulation cake base 132 and an insulation sidewall ring 134. The heater element 140 is supported on the insulation cake base 132 and is preferably a ribbon-type heater element that is spirally wound. In this embodiment, the heater element 140 has a first and second terminal end 142, 144 that allows the heater element to be electrically connected to the control system 60 (see FIG. 6). The terminal ends 142, 144 of the heater element 140 are connected to the control system 60 via the terminal block 146. The second terminal end 144 passes through the center of the insulation cake 132 and is then routed to the outer edge of the heating unit 110 through the insulation cake 132.

Figure 5A:
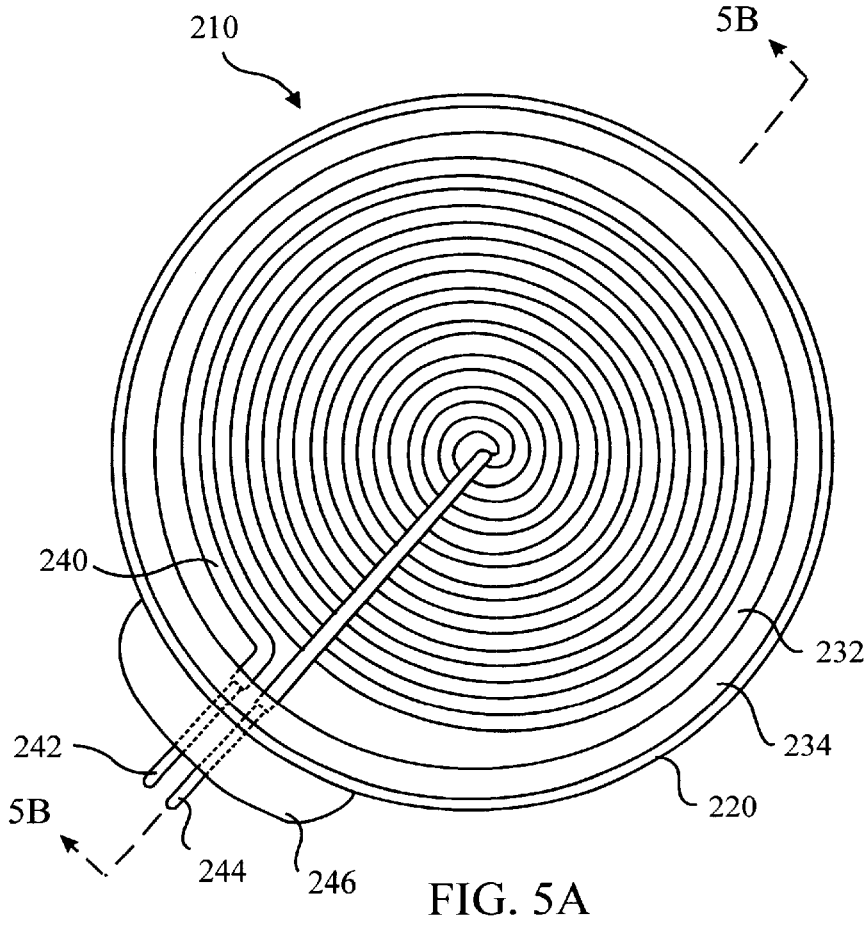
FIG. 5A is a top view of another alternative embodiment of a heating unit of the present invention.
Figure 5B:
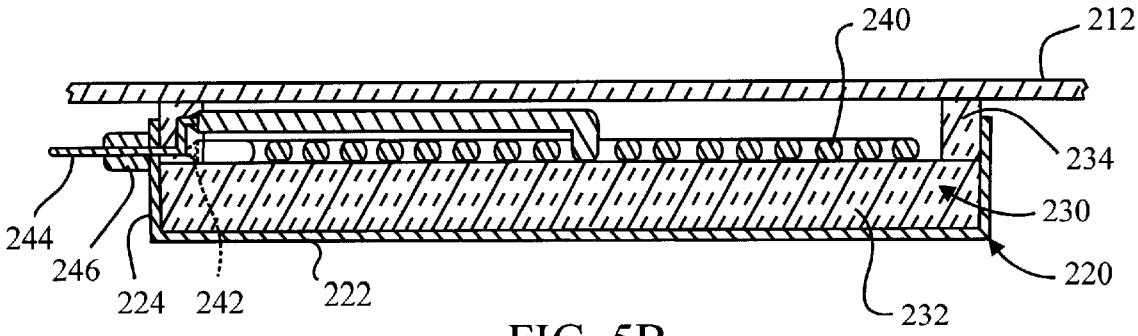
FIG. 5B is a cross-sectional view of the heating unit in FIG. 5A.

In FIGS. 5A and 5B, a heating unit 210 includes a support pan 220, an insulation layer 230, and a heater element 240. The support pan 220 is disposed beneath the cooking surface 12 and may comprise a substantially flat base 222 and a circumferential sidewall 224. The insulation layer 230 is supported inside the support pan 220. The insulation layer 230 may have an insulation cake base 232 and an insulation sidewall ring 234. The heater element 240 is supported on the insulation cake base 232 of the insulation layer 230 and is preferably a ribbon-type heater element that is spirally wound. In this embodiment, the heater element 240 has two terminal ends 242, 244 that allow the heater element to be electrically connected to the control system 60 (see FIG. 6). The terminal ends 242, 244 of the heater element 240 are connected to the control system 60 via the terminal block 246. The second terminal end 244 is routed from the center of the heating unit 210 to the outer edge of the heating unit 210 by passing the second terminal end 244 over the heater element 240.

Figure 6:
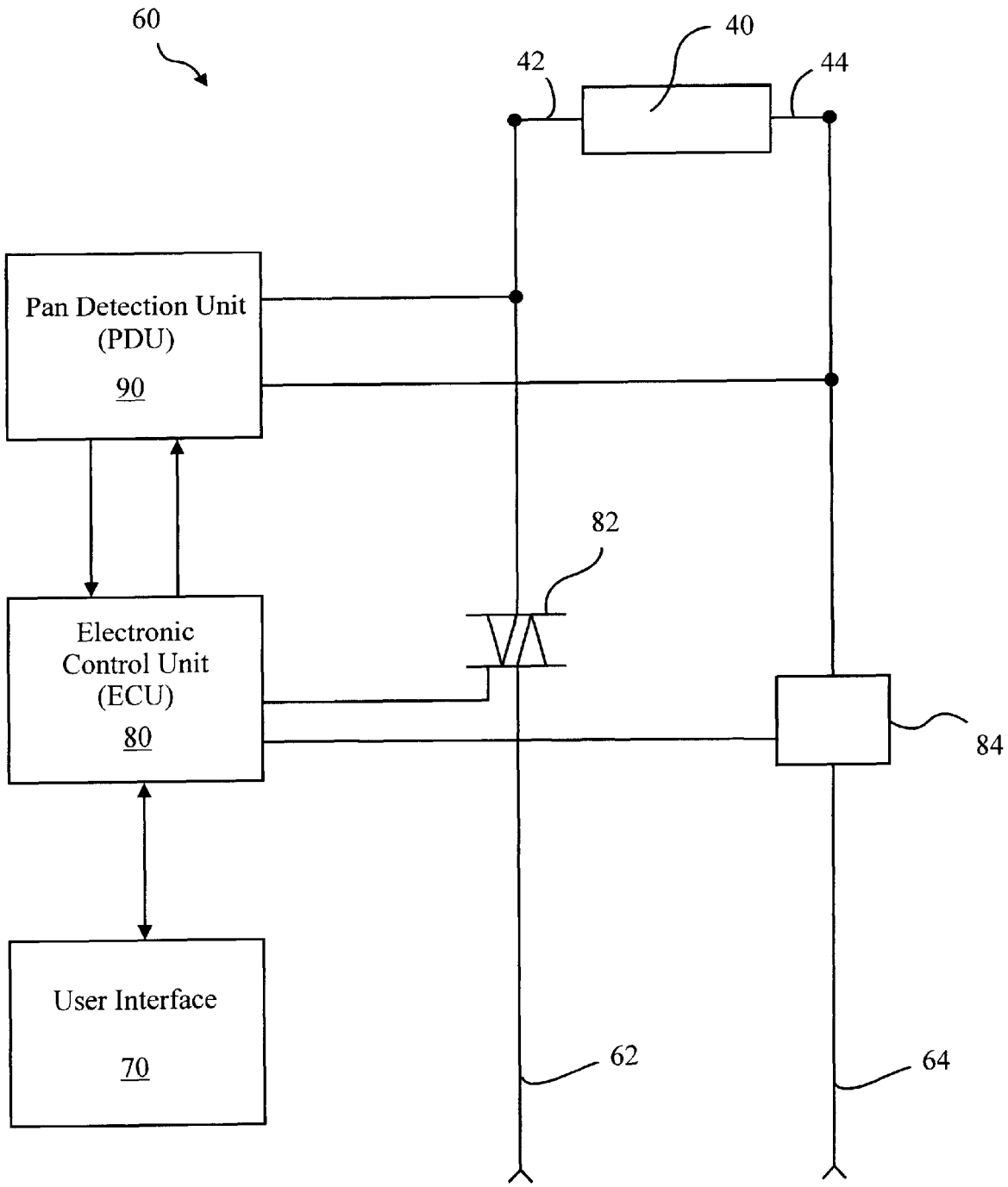
FIG. 6 is a schematic view of one embodiment of a control system of the present invention.

Referring to FIG. 6, one embodiment of a control system 60 for the present invention includes a user interface 70, an electronic control unit 80, switch devices 82, 84, and a pan detection unit 90. As explained above, the heater element 40 is preferably a spirally wound, ribbon-type heater element. The heater element 40 has a first and second terminal end 42, 44. The terminal ends 42, 44 of the heater element 40 are connected to AC power lines 62, 64 through switch devices 82, 84 to supply a voltage, for example, 240 VAC. The switch devices 82, 84 are controlled by the electronic control unit 80. The switching devices 82, 84 supply AC power to the heater element when closed. As described in more detail below, the switching devices are also used to remove power to the heater element 40 when at least one of the switching devices are open. The switch devices 82, 84 may be relays, triacs, SCRs, or other types of electronically controlled switches. In one embodiment, the switch device 82 for the line associated with the first terminal end 42 is a triac and the switch device 84 for the line associated with the second terminal end 44 is a relay. The switch device 84 for the line associated with the second terminal end 44 acts as a safety device that disables during fault conditions or during extended periods of inoperation. The switch device 82 for the line associated with the first terminal end 42 turns the heater element 40 on and off according to the amount of heat required at any given instant in time. A triac is a suitable switch device 82 for this type of application because it is a fast acting switching device. A standard relay is typically too slow. As will be described later, in one embodiment, at least the faster acting switch (switch device 82) is disabled during the time period when the reactance of the heater element 40 is being measured.

The user interface 70 may be a simple input knob 16 (see FIG. 1), or a touch or wireless keyboard with advanced optical indicating devices. If an input knob 16 were used, the knob 16 would have a plurality of settings. For example, the knob 16 may have settings 1–10 where setting 1 refers to minimum heat and setting 10 refers to maximum heat. A user places a cooking pan or utensil on the cooking surface 12 above a heating unit 10 and turns the control knob 16 to a desired setting. For boiling liquids, a user will typically select the highest setting. The electronic control unit 80 will receive the desired setting from the knob 16.

The electronic control unit 80 acts as the master controller of the system. The electronic control unit 80 receives a desired setting from the user through the user interface 70. The electronic control unit 80 controls the application of power to the heater element 40 by activating the switch device 82 to achieve the desired setting. The electronic control unit 80 may also shut down the heater element 40 during a fault by disconnecting power through the switch device 84. In one embodiment, a temperature sensor (not shown) may be used to determine whether a desired setting has been reached. In such a case, the electronic control unit 80 assigns a temperature set point according to the desired setting selected by the user of the cooktop 14. The electronic control unit 80 turns on the power to the heater element 40 (through switch device 82) until the temperature set point is reached. After the first temperature set point has been reached, the temperature is maintained by duty cycling the power supplied to the heater element 40. The operation of the electronic control unit 80 may be accomplished by a PID (Proportional, Integral, Derivative) control loop or a PI (Proportional, Integral) control loop.

The electronic control unit 80 is also electrically connected to the pan detection unit 90 to determine the presence (or absence) of a cooking pan or utensil on the cooking surface 12 above a heating unit 10. The pan detection unit 90 consists of circuitry that indicates the reactance of the heater element 40. The pan detection unit 90 is electrically connected between the terminal ends 42, 44 and the switch devices 82, 84 to provide a radio frequency signal to the heater element 40. The signal is generated such that any changes in the reactance of the heater element 40 will affect at least one parameter of the signal, i.e. amplitude, phase, time delay, frequency, or other characteristic.

In this embodiment, the electronic control unit 80 sends control signals to the pan detection unit 90 indicating when the radio frequency signal is to be enabled, and when the reactance of the heater element 40 is to be measured. The pan detection unit 90 responds with sensing signals indicative of the reactance magnitude of the heater element 40. The electronic control unit 80 uses the received reactance magnitude from the pan detection unit 90 to determine whether a pan is present on the cooking surface 12. Alternatively, the pan detection unit 90 may respond with an on-off indication of the presence of a cooking pan or utensil.

Figure 7:
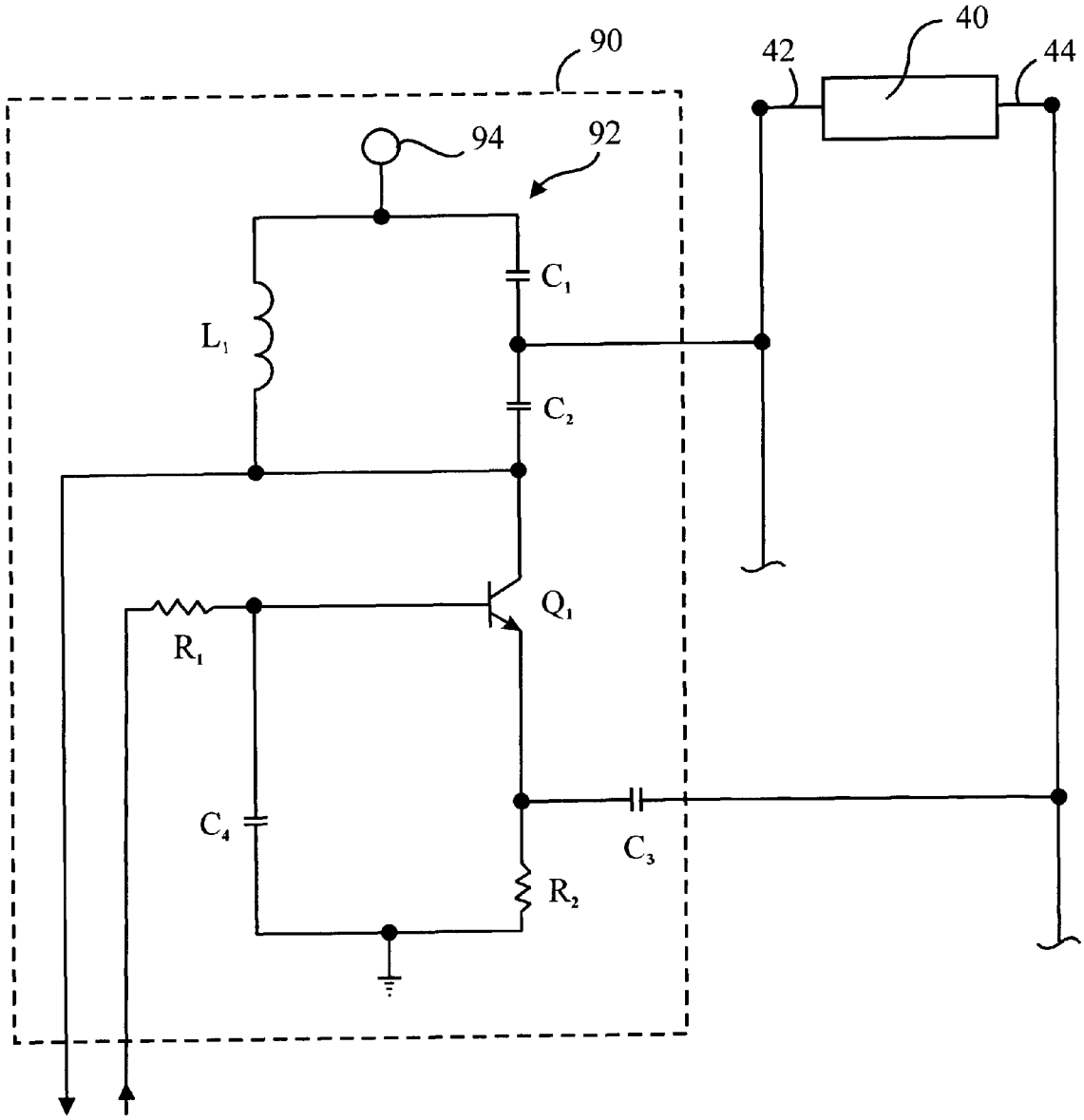
FIG. 7 is a schematic of one embodiment of the pan detection unit of the control system shown in FIG. 6.

FIG. 7 illustrates one embodiment of a pan detection unit 90. It has been discovered that monitoring differences in reactance or inductance can determine whether a pan is present on top of the cooking surface 12. Accordingly, in one embodiment, the pan detection unit 90 indicates the reactance of the heater element 40 through the generation of a high-frequency current by an oscillation circuit 92. In one embodiment, as shown in FIG. 7, the oscillation circuit 92 is a Colpitts oscillator. One of ordinary skill in the art, however, having the benefit of the present specification would realize that other types of oscillation circuits may be used such as a Hartley, phase lock loop, or numerous other oscillators.

The oscillation frequency of the Colpitts oscillator in FIG. 7 is determined by the inductor L1, capacitors C1, C2, C3, and the heater element 40. Typically, a frequency that can provide an optimum oscillation is selected from among frequencies of 100 KHz to 10 MHz, although other frequencies could be used. The pan detection unit 90 further includes a resistance R2 connected to the emitter of the transistor Q1 for varying the conditions of oscillation. As the resistance value of the resistance R2 is varied, the oscillation amplitude value varies. In one embodiment, a source voltage 94 for the oscillation circuit 92 was set at +5V, although one of ordinary skill in the art would realize that other voltages may be used.

To begin the process of determining whether a cooking pan or utensil is present (or absent) from the cooking surface 12, in one embodiment, the electronic control unit 80 opens at least the faster switch device (here, switch device 82) to remove power supplied to the heater element 40. It was found that the external AC power lines 62, 64 present an unknown impedance at the radio frequencies typically used in detecting the presence of a cooking pan or utensil. Any variations would directly affect the reliability of measuring the reactance of the heater element 40. Alternatively, the external AC power lines 62, 64 could be reduced by a line impedance stabilization network (not shown). This is a specially designed filter that prevents the radio frequency signals from reaching the power lines. The filter would have to be heavy enough to carry the full heating power of the heater element 40. To be effective, such a filter may be unreasonably large and expensive. Accordingly, the preferred method is isolating the heater element 40 from the external AC power lines 62, 64 through opening at least the faster switch device 82.

After power is removed to the heater element 40, the electronic control unit 80 may send a control signal to the pan detection unit 90 (and oscillation circuit 92) through the line having resistance R1. As explained above, the oscillation circuit 92 then generates a high-frequency current through heater element 40. Any change of reactance in the heater element 40 will cause a subsequent change in the oscillator's frequency. In one embodiment, the electronic control unit 80 has a frequency counting circuit. The pulse signal from the collector of the transistor Q1 can be used by a frequency counting circuit in the electronic control unit 80 as an indication of the reactance of the heater element 40.

One requirement of heating units is that they now be able to rapidly heat up to an operating temperature. This is evidenced by a heater element 40 of the heating unit 10 reaching a visual response temperature within 3–5 seconds after application of power, by which time the heater element 40 is glowing. Rapid heating of element 40 may be achieved by applying a voltage, for example, 240 VAC across the heater element 40. The voltage is applied the entire time the heater element 40 is on. While this achieves rapid heating, the tradeoff has been increased temperature stress on the heater element 40 and cooking surface 12. This may result in reduced service life of the cooking surface 12. Thus, it is desirable to have a control system that minimizes the temperature stresses on the cooking surface 12. Accordingly, in one operational mode of the present invention, the electronic control unit 80 determines whether a cooking pan or utensil is present (or absent) on the cooking surface 12 above a heating unit 10. As explained above, this is done with the use of the pan detection unit 90. If a cooking pan or utensil is present, the electronic control unit 80 can then perform a fast heating cycle by closing the switch device 82 without duty cycling. When the desired temperature has been reached, the electronic control unit 80 may then duty cycle. If no pan is present, the electronic control unit 80 may not turn on the heater element 40 or it may perform a slow heating cycle by duty cycling the switch device 82 until the desired temperature is reached.

Figure 8:
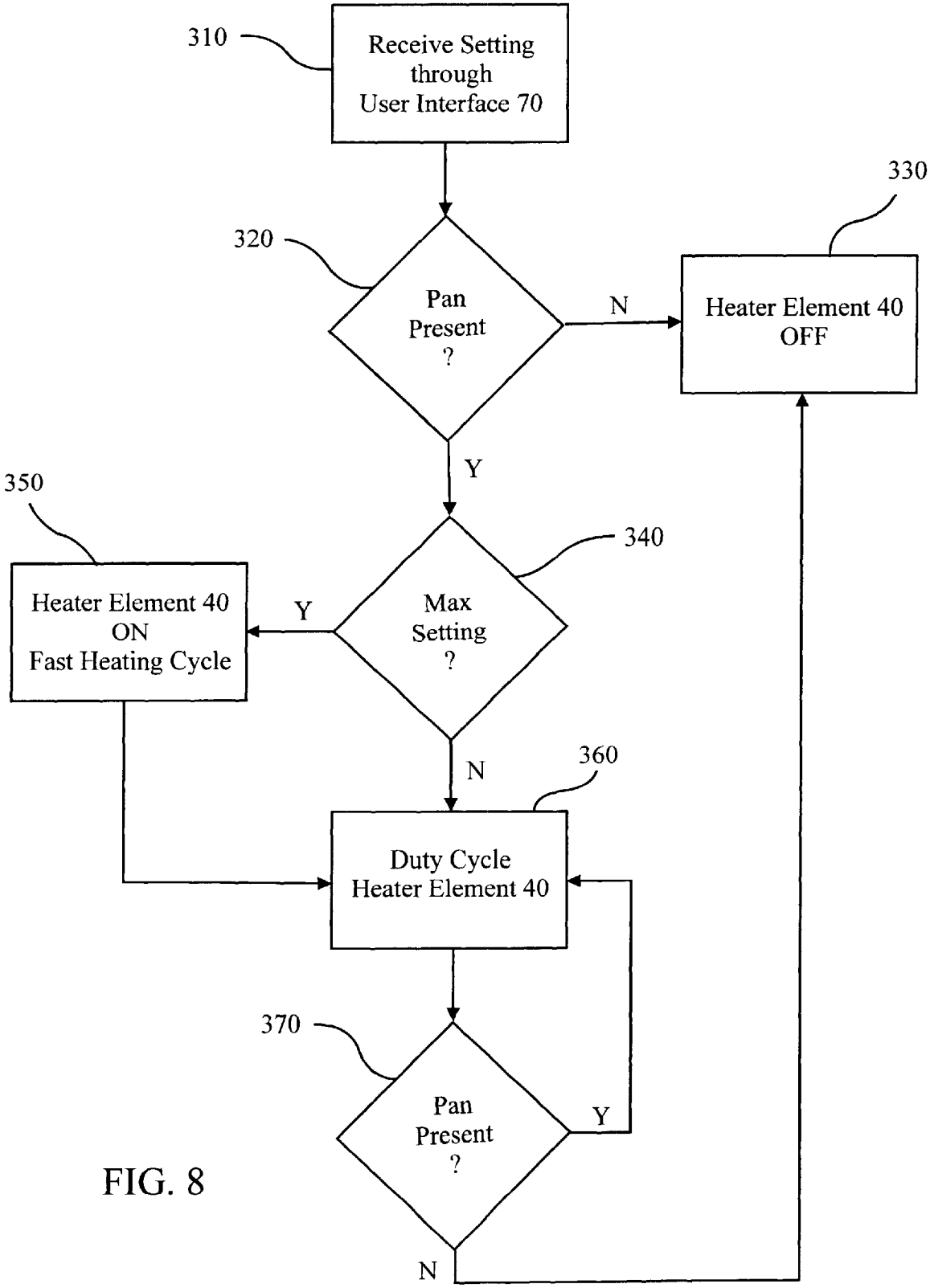
FIG. 8 is a flow chart of one embodiment of a method of operating a heating unit according to the present invention.

The present invention also includes a method of operating a heating unit 10 with a control system 60 that senses the presence (or absence) of a cooking pan or utensil. Referring to the block diagram in FIG. 8, in Block 310, the control system 60 receives a temperature setting through the user interface 70. As explained above, the temperature setting may be received through a simple input knob 16 (see FIG. 1), or a touch or wireless keyboard with advanced optical indicating devices. If an input knob 16 were used, the knob 16 may have a plurality of settings. For example, the knob 16 may have settings 1–10 where setting 1 refers to minimum heat and setting 10 refers to maximum heat.

In block 320, the control system 60 determines whether a cooking pan or utensil is present on the cooking surface 12 above the heating unit 10. As explained above, in one embodiment, the electronic control unit 80 removes power to the heater elements 40 by opening at least one of the switch devices 82, 84. This should preferably be a faster acting switch such as a triac. The electronic control unit 80 then sends a control signal to the pan detection unit 90 indicating that a radio frequency signal should be generated and sent through the heater element 40. The pan detection unit 90 responds with sensing signals indicative of the reactance magnitude of the heater element 40. The electronic control unit 80 uses the received reactance magnitude from the pan detection unit 90 to determine whether a cooking pan or utensil is present on the cooking surface 12. If a cooking pan or utensil is not present, the control system 60 may keep the heater element 40 off (see block 330). Otherwise, if a cooking pan or utensil is present, the control system 60 may go on to block 340.

In block 340, the control system 60 may then determine whether the setting received in block 310 refers to maximum heat. If the setting refers to maximum heat, the control system 60 then turns the heater element 40 on a fast heating cycle. For example, to boil liquids, a user will typically select maximum heat. The electronic control unit 80 may do this. As explained above, rapid heating of the heater element 40 may put increased temperature stress on the cooking surface 12. This is especially true when no cooking pan or utensil is present on the cooking surface 12. When a cooking pan or utensil is present on the cooking surface 12, the cooking pan or utensil may act as a heat sink that reduces the amount of temperature stress on the cooking surface 12. Accordingly, before entering a fast heating cycle (block 350) it may be important to know whether a cooking pan or utensil is present on the cooking surface 12. If the setting does not refer to maximum heat, there are a variety of ways known to those of ordinary skill in the art to turn on the heater element 40 to achieve the desired setting. In one embodiment, the heater element 40 is turned on and after the desired temperature setting has been reached the setting is maintained by duty cycling the power supplied to the heater element 40 (block 360).

Between duty cycling the power supplied to the heater element 40, the control system 60 may continue to check whether the cooking pan or utensil is still present on the cooking surface 12 (block 370). The same procedure as described above in relation to block 360 may be used. Namely, in one embodiment, the electronic control unit 80 removes the AC power from the heater element 40 by opening at least switch device 82. The electronic control unit 80 then sends a control signal to the pan detection unit 90 indicating that a radio frequency signal should be generated and sent through the heater element 40. The pan detection unit 90 responds with sensing signals indicative of the reactance magnitude of the heater element 40. The electronic control unit 80 uses the received reactance magnitude from the pan detection unit 90 to determine whether a cooking pan or utensil is present on the cooking surface 12. If a cooking pan or utensil is still present, the control system 60 continues to maintain the setting by continuing to duty cycle the power supplied to the heater element 40 (see block 360). Otherwise, if the cooking pan or utensil has been removed, the control system 60 may go on to block 330 and turn off the heater element 40.

Figure 9A:
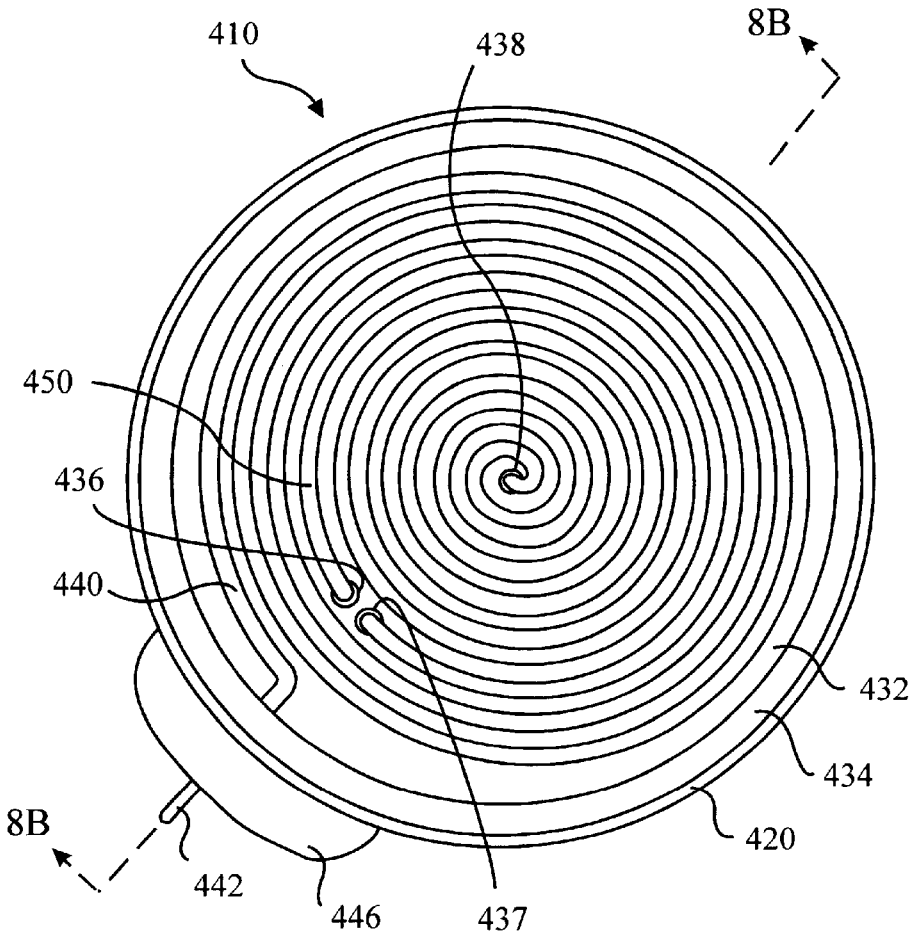
FIG. 9A is a top view of an alternative embodiment of a heating unit of the present invention having two separate heater elements.
Figure 9B:
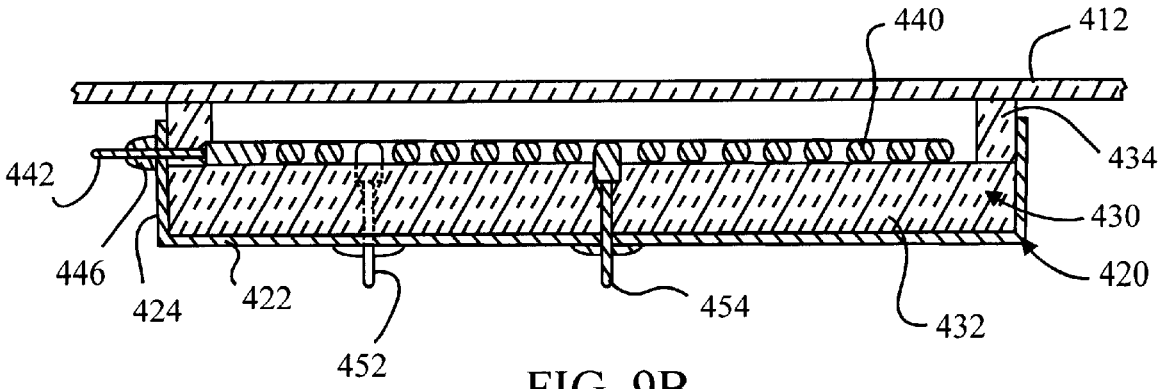
FIG. 9B is a cross-sectional view of the heating unit in FIG. 9A.

In another embodiment, the present invention includes a heating unit having two or more heater elements. Referring to FIGS. 9A and 9B, in one embodiment, a heating unit 410 includes a support pan 420, an insulation layer 430, an outer heater element 440, and an inner heater element 450. The support pan 420 is disposed beneath the cooking surface 12 and may be a shallow pan having a substantially flat base 422 and a circumferential sidewall 424. The insulation layer 430 is supported inside the support pan 420. Specifically, in one embodiment, as shown in FIG. 9B, the insulation layer 430 has an insulation cake base 432 and an insulation sidewall ring 434. Although FIG. 9B shows the insulation layer 430 as two separate components, the insulation cake base 432 and the sidewall ring 434 may be a single unitary body. Similar to the previous embodiments, suitable materials for the insulation layer include Wacker WDS® Thermal Insulation from Wacker Silicones Corp. in Adrian, Mich. and RPC2100 from Thermal Ceramics in Augusta, Ga.

The heater elements 440, 450 are supported on the insulation cake base 432 of the insulation layer 430. The presence of the insulation sidewall ring 434 permits the heater elements 440, 450 to be in a spaced-apart relationship to the cooking surface 12. The insulation sidewall ring 434 further assists in confining the heat to the area directly above the heater elements 440, 450 by minimizing the amount of heat loss to the sides of the heater unit 410.

The heater elements 440, 450 are preferably electric ribbon-type heater elements. The heater elements 440, 450 radiate infrared energy. The outer heater element 440 has terminal ends 442, 444 and the inner heater element 450 has terminal ends 452, 454. (Note: The terminal end 444 is not specifically shown in FIG. 9B. Terminal 444, however, extends downward through hole 437 similar to terminal end 452). The terminal ends allow the heater elements 440, 450 to be electrically connected to a control system 460 (see FIG. 10). The control system 460 enables power to be supplied through the heater elements 440, 450. Conventional heater elements typically have a serpentine, sinuous or zigzag pattern. However, in the present invention, it is preferred that the heater elements have a spirally wound pattern when installed on the insulation cake base 432. Accordingly, the embodiment illustrated in FIG. 9A shows the inner heater element 450 spirally wound within the outer heater element 440. The purpose of dual heater elements is to conserve energy and to preserve the life of the cooking surface 12. Depending on the size of the cooking pan or utensil, the control system 460 will turn on both heater elements 440, 450 (for a large cooking pan or utensil) or simply turn on the inner heater element 450 (for a small cooking pan or utensil).

In one embodiment, the first terminal end 442 of the outer heater element 440 is connected to the control system 460 via the terminal block 446. The second terminal end 444 of the outer heater element 440 passes through a hole 437 in the insulation cake base 432 to connect to the control system 460. The first terminal end 452 of the inner heater element 450 passes through a hole 436 in the insulation cake base 432 to connect to the control system 460. The second terminal end 454 of the inner heater element 450 passes through a center hole 438 in the insulation cake base 432 to connect to the control system 460.

Similar to the previously described embodiments, the control system 460 uses the electromagnetic effects of an electrically conductive cooking pan or utensil upon the electrical reactance of the spirally wound, electric ribbon-type heater elements 440, 450 to detect the presence (or absence) of the cooking pan or utensil. Each heater element 440, 450 is excited by a radio frequency signal that produces an electromagnetic field. The presence of a cooking pan or utensil (not shown) disrupts the electromagnetic field causing an apparent change in the reactance of each heater element 440, 450. The change of reactance can be measured at the terminal ends of the heater elements 440, 450. Depending on the reactance for each heater element 440, 450, the control system 460 can further determine whether a large or small cooking pan or utensil has been placed on the cooking surface 12 above the heating unit 410. Based on this information, the control system 460 may decide whether to activate one or both of the heater elements 440, 450.

Figure 10:
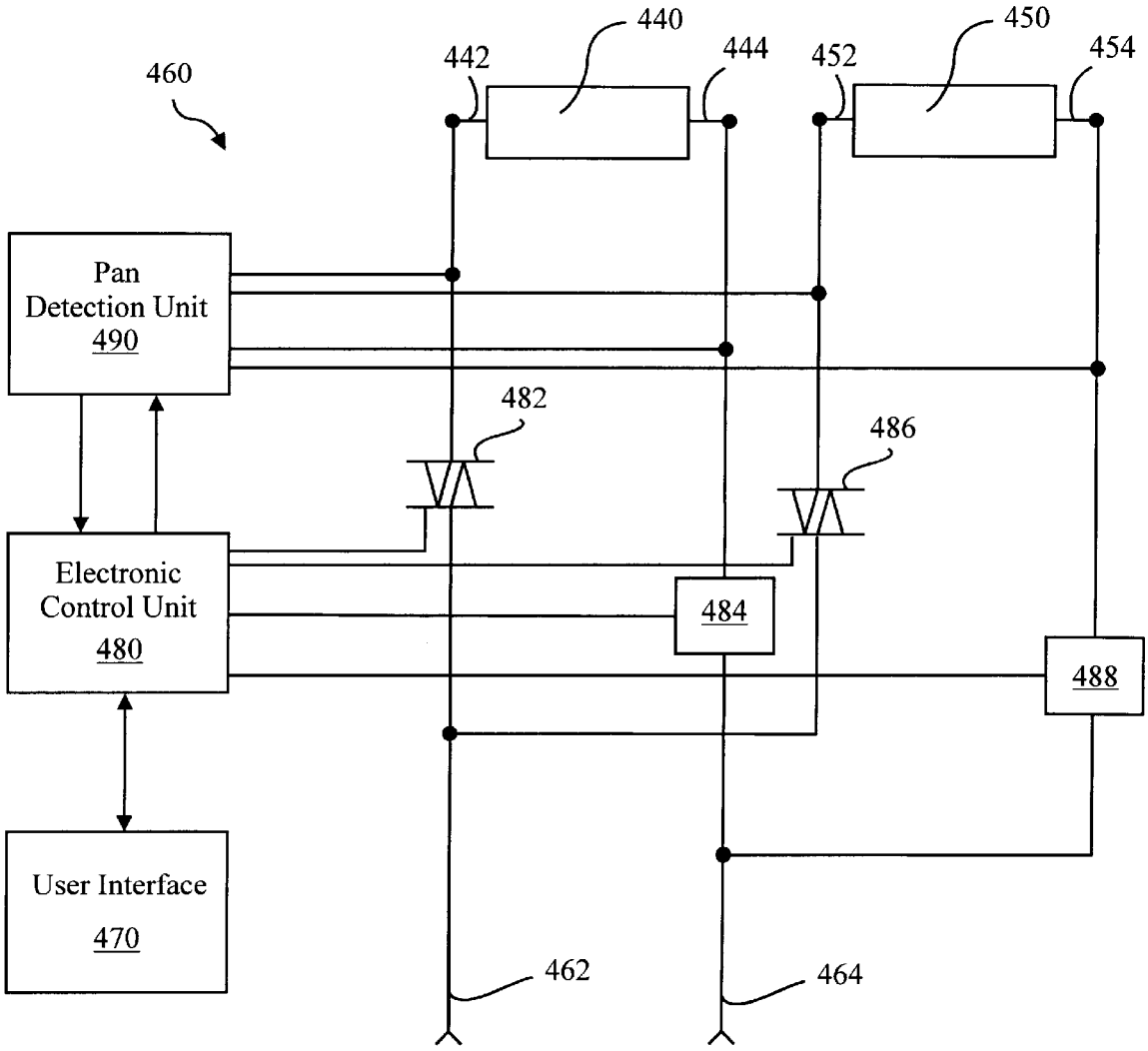
FIG. 10 is an electrical schematic view of another embodiment of a pan detection system of the present invention for a heating unit having two separate heater elements.

The control system 460 for heating unit 410 is similar to the one described above for the previous embodiments. Referring to FIG. 10, one embodiment of the control system 460 includes a user interface 470, an electronic control unit 480, switch devices 482, 484, 486, 488 and a pan detection unit 490. As explained above, the heater elements 440, 450 are preferably a spirally wound, ribbon-type heater element. The outer heater element 440 has terminal end 442, 444. The terminal ends 442, 444 of the outer heater element 440 are connected to AC power lines 462, 464 through switch devices 482, 484 to supply a voltage, for example, 240 VAC. The inner heater element 450 has terminal end 452, 454. The terminal ends 452, 454 of the inner heater element 450 are connected to AC power lines 462, 464 through switch devices 486, 488.

The switch devices 482, 484, 486, 488 are controlled by the electronic control unit 480. The switch devices 482, 484, 486, 488 may be relays, triacs, SCRs, or other types of electronically controlled switches. In one embodiment, the switch devices 482, 486 for the line associated with the first terminal ends 442, 452 of the heater elements are triacs. The switch devices 484, 488 for the line associated with the second terminal ends 444, 454 are relays. The switch devices 484, 488 for the line associated with the second terminal ends 444, 454 act as safety devices that disable during fault conditions or during extended periods of inoperation. The switch devices 482, 486 for the line associated with the first terminal ends 442, 452 turn the heater elements 440, 450 on and off according to the amount of heat required at any given instant in time. Triacs are suitable switch devices 482, 486 for this type of application because they are fast acting switching devices. Additionally, the switch devices 482, 486 associated with a particular heater element 440, 450 are disabled during the time period when the reactance of one of the heater elements 440, 450 are being measured.

The user interface 470 may be a simple input knob 16 (see FIG. 1), or a touch or wireless keyboard with advanced optical indicating devices. If an input knob 16 were used, the knob 16 would have a plurality of settings. For example, the knob 16 may have settings 1–10 where setting 1 refers to minimum heat and setting 10 refers to maximum heat. A user places a cooking pan or utensil on the cooking surface 12 above a heating unit 10 and turns the control knob 16 to a desired setting. For boiling liquids, a user will typically select the highest setting. The electronic control unit 480 will receive the desired setting from the knob 16.

The electronic control unit 480 acts as the master controller of the system. The electronic control unit 480 receives a desired setting from the user through the user interface 470. The electronic control unit 480 controls the application of power to the heater elements 440, 450 by activating the switch devices 482, 486 to achieve the desired setting. The electronic control unit 480 may also shut down either heater element 440, 450 during a fault by disconnecting power through the switch devices 484, 488. In one embodiment, a temperature sensor (not shown) may be used to determine whether a desired setting has been reached. In such a case, the electronic control unit 480 assigns a temperature set point according to the desired setting selected by the user of the cooktop 14. The electronic control unit 480 turns on the power to one or both heater elements 440, 450 (through switch devices 482, 486) until the temperature set point is reached. After the first temperature set point has been reached, the temperature is maintained by duty cycling the power supplied to the heater elements 440, 450. The operation of the electronic control unit 480 may be accomplished by a PID (Proportional, Integral, Derivative) control loop or a PI (Proportional, Integral) control loop.

The electronic control unit 480 is also electrically connected to the pan detection unit 490 to determine the presence (or absence) of cooking pan or utensil on the cooking surface 12 above a heating unit 410. In this embodiment, the electronic control unit 480 may also determine (through the pan detection unit 490) whether a small or large cooking pan or utensil has been placed on the cooking surface 12 above a heating unit 410. The pan detection unit 490 may consist of circuitry that is similar to the circuitry above described in relation to FIG. 7. In one embodiment, the pan detection unit 490 has a separate oscillating circuit for each heater element 440, 450. Alternatively, the pan detection unit 490 has a single oscillating circuit for each heater element 440, 450 but has relays or other switches to send a signal to each heater element 440, 450. The circuitry of the pan detection unit 490 indicates the reactance of the heater elements 440, 450. The pan detection unit 490 is electrically connected between the terminal ends of the heater elements 440, 450 and the switch devices 482, 484, 486, 488 to provide a radio frequency signal to each heater element 440, 450. The signal is generated such that any changes in the reactance of either heater element 440, 450 will affect at least one parameter of the signal, i.e. amplitude, phase, time delay, frequency, or other characteristic.

In this embodiment, the electronic control unit 480 sends control signals to the pan detection unit 490 indicating when the radio frequency signal is to be enabled, and when the reactance of either heater element 440, 450 is to be measured. The pan detection unit 490 responds with sensing signals indicative of the reactance magnitude of for each heater element 440, 450. The electronic control unit 480 uses the received reactance magnitude from the pan detection unit 490 to determine whether a pan is present on the cooking surface 12. The electronic control unit 480 also uses the received reactance magnitude from the pan detection unit 490 to determine whether a small or large pan is present on the cooking surface 12. Alternatively, the pan detection unit 490 may respond with an indication of the presence of a cooking pan or utensil or an indication on the size of the cooking pan or utensil.

What has been described is radiant heating units for use in cooktops that are capable of determining the presence of a cooking pan or utensil. The heating unit has a simple construction so the cooktop requires fewer parts than cooktops using conventional pan detection methods. This not only reduces costs, but also maintenance time.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A control system for a heating unit in a cooktop, the heating unit having a spirally wound ribbon heater element, the control system comprising a pan detection unit electrically connected to the heater element, wherein the pan detection unit is capable of generating a high frequency signal through the heater element to determine whether a pan is present on the cooktop.

2. The control system of claim 1, wherein the cooktop has a glass-ceramic cooking surface, the heating unit and heater element mounted below the glass-ceramic cooking surface.

3. The control system of claim 1, wherein the pan detection unit has an oscillation circuit to generate the high frequency signal through the heater element.

4. The control system of claim 1, wherein the control system further includes an electronic control unit that is electrically connected to the pan detection unit, the electronic control unit capable of generating a signal to the pan detection unit to enable the pan detection unit to generate the high frequency signal through the heater element.

5. The control system of claim 4, wherein the pan detection unit is capable of sending a response signal to the electronic control unit after the electronic control unit sends the signal to the pan detection unit to enable the pan detection unit to generate the high frequency signal through the heater element.

6. The control system of claim 5, wherein the response signal from the pan detection unit to the electronic control unit reflects at least a portion of a reactance of the heater element.

7. The control system of claim 4, wherein the control system further includes a user interface that is electrically connected to the electronic control unit, the user interface capable of receiving a setting from a user of the cooktop.

8. The control system of claim 4, wherein the control system further includes a first switch device and a second switch device connected between the heater element and a power source, the first and second switch devices being electronically controlled by the electronic control unit.

9. The control system of claim 8, wherein the first switch device is a triac.

10. The control system of claim 9, wherein the first switch device is opened to remove the power source from the heater element when the pan detection unit generates the high frequency signal through the heater element.

11. A control system for a heating unit in a cooktop, the heating unit having a heater element, the heater element having a first terminal end and a second terminal end, the control system comprising:

a pan detection unit electrically connected to the first and second terminal ends of the heater element, the pan detection unit capable of generating a high frequency signal through the heater element to determine whether a pan is present on the cooktop; and a switch device electrically connected between the heater element and a power source;

wherein the switch device is opened to remove the power source from the heater element when the pan detection unit generates the high frequency signal through the heater element.

12. The control system of claim 11, wherein the cooktop has a glass-ceramic cooking surface, the heating unit and heater element mounted below the glass-ceramic cooking surface.

13. The control system of claim 11, wherein the pan detection unit has an oscillation circuit to generate the high frequency signal through the heater element.

14. The control system of claim 11, wherein the control system further includes an electronic control unit that is electrically connected to the pan detection unit, the electronic control unit capable of generating a signal to the pan detection unit to enable the pan detection unit to generate the high frequency signal through the heater element.

15. The control system of claim 14, wherein the pan detection unit is capable of sending a response signal to the electronic control unit after the electronic control unit sends the signal to the pan detection unit to enable the pan detection unit to generate the high frequency signal through the heater element.

16. The control system of claim 15, wherein the response signal from the pan detection unit to the electronic control unit reflects at least a portion of a reactance of the heater element.

17. The control system of claim 14, wherein the control system further includes a user interface that is electrically connected to the electronic control unit, the user interface capable of receiving a setting from a user of the cooktop.

18. The control system of claim 11, wherein the switch device is a triac.

19. A control system for a heating unit in a cooktop, the heating unit having an inner heater element and an outer heater element, the inner and outer heater elements being spirally wound wherein the inner heater element is spirally wound within the outer heater element, the control system comprising:

a pan detection unit electrically connected to the inner and outer heater elements, the pan detection unit capable of generating a high frequency signal through the inner heater element to determine whether a pan is present on the cooktop, the pan detection unit further capable of generating a high frequency signal through the outer heater element to determine a size of the pan on the cooktop;

a first switch device electrically connected between the inner heater element and a power source; and a second switch device electrically connected between the outer heater element and the power source;

wherein the first switch device is opened to remove the power source from the inner heater element when the pan detection unit generates the high frequency signal through the inner heater element to determine whether the pan is present on the cooktop, and the second switch device is opened to remove the power source from the outer heater element when the pan detection unit generates the high frequency signal through the outer heater element to determine the size of the pan on the cooktop.

20. The control system of claim 19, wherein the cooktop has a glass-ceramic cooking surface, the heating unit and heater element mounted below the glass-ceramic cooking surface.

21. The control system of claim 19, wherein the pan detection unit has at least one oscillation circuit to generate the high frequency signals through the inner and outer heater elements.

22. The control system of claim 19, wherein the control system further includes an electronic control unit that is electrically connected to the pan detection unit, the electronic control unit capable of generating a signal to the pan detection u nit to enable the pan detection unit to generate the high frequency signals through the inner and outer heater elements.

23. The control system of claim 22, wherein the pan detection unit is capable of sending a response signal to the electronic control unit after the electronic control unit sends the signal to the pan detection unit to enable the pan detection unit to generate the high frequency signals through the inner and outer heater elements.

24. The control system of claim 23, wherein the response signal from the pan detection unit to the electronic control unit reflects at least a portion of a reactance of either the first or second heater element.

25. The control system of claim 22, wherein the control system further includes a user interface that is electrically connected to the electronic control unit, the user interface capable of receiving a setting from a user of the cooktop.

26. The control system of claim 19, wherein the first switch device and second switch device are triacs.

27. A method of operating a heating unit for a cooktop with a control system that is capable of detecting whether a pan is present on the cooktop, the heating unit having a heater element, the method comprising:

receiving a setting from a user of the cooktop;

generating a high frequency signal through the heater element;

determining whether the pan is present on the cooktop from the generation of the high frequency signal through the heater element;

isolating power to the heater element if it is determined that the pan is not present on the cooktop;

providing power to the heater element if it is determined that the pan is present on the cooktop;

determining whether the pan has been removed from the cooktop after power has been provided to the heater element;

isolating power to the heater element if it is determined that the pan has been removed from the cooktop; and providing power to the heater element if it is determined that the pan has not been removed from the cooktop.

28. The method of claim 27, wherein the step of generating the high frequency signal through the heater element is performed by a pan detection unit having an oscillation circuit.

29. The method of claim 28, wherein the step of determining whether the pan is present on the cooktop is performed by an electronic control unit that is electrically connected to the pan detection unit.

30. The method of claim 28, wherein the step of determining whether the pan has been removed from the cooktop is performed by an electronic control unit that is electrically connected to the pan detection unit.

31. A control system for a heating unit in a cooktop, the heating unit having a heater element, the heater element having a first terminal end and a second terminal end, the control system comprising:

a means for receiving a setting from a user of the cooktop;

a means for generating a high frequency signal through the heater element;

a means for determining whether a pan is present on the cooktop; and a means for isolating power to the heater element if it is determined that the pan is not present on the cooktop.

32. The control system of claim 31, wherein the cooktop has a glass-ceramic cooking surface, the heating unit and heater element mounted below the glass-ceramic cooking surface.

33. The control system of claim 31, wherein the means for generating the high frequency signal through the heater element includes at least an oscillation circuit.

34. The control system of claim 31, wherein the control system further includes an electronic control unit that is electrically connected to the means for generating the high frequency signal through the heater element.

* * * * *

UNITED STATES PATENT AND TRADEMARK OFFICE

CERTIFICATE OF CORRECTION

PATENT NO. : 6,492,627 B1
DATED : December 10, 2002
INVENTOR(S) : James W. Ensinger et al.

It is certified that error appears in the above-identified patent and that said Letters Patent is hereby corrected as shown below:

Column 15,
Line 23, delete “u nit” and insert -- unit --

Signed and Sealed this

Thirteenth Day of May, 2003

JAMES E. ROGAN
*Director of the United States Patent and Trademark Office*